US007571626B2

(12) United States Patent
Choi et al.

(10) Patent No.: US 7,571,626 B2
(45) Date of Patent: Aug. 11, 2009

(54) DRUM WASHING MACHINE

(75) Inventors: Dong Hyun Choi, Gunpo-Si (KR); Woon Gu Hur, Suwon-Si (KR); Se Hyeong Lee, Suwon-Si (KR); Won Seok Choi, Suwon-Si (KR); Myung Sun Kang, Suwon-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 444 days.

(21) Appl. No.: 11/475,940

(22) Filed: Jun. 28, 2006

(65) Prior Publication Data

US 2007/0044521 A1 Mar. 1, 2007

(30) Foreign Application Priority Data

Sep. 1, 2005 (KR) ..... 10-2005-0081311

(51) Int. Cl.
*D06F 39/14* (2006.01)

(52) U.S. Cl. ..... 68/196

(58) Field of Classification Search ..... 68/196; 134/184, 198

See application file for complete search history.

(56) References Cited

U.S. PATENT DOCUMENTS 2,843,945 A * 7/1958 Whyte ..... 34/82
2,910,854 A * 11/1959 Hughes ..... 68/18 R
2,968,174 A * 1/1961 Bell et al. ..... 68/23.6
3,159,174 A * 12/1964 Mann et al. ..... 137/374
7,251,963 B2 * 8/2007 Kim et al. ..... 68/196

FOREIGN PATENT DOCUMENTS

| | | |
|---|---|---|
| CN | 1106475 | 4/2003 |
| JP | 61-41678 | 3/1986 |
| JP | 10-328473 | 12/1998 |
| KR | 10-0240120 | 10/1999 |

OTHER PUBLICATIONS

Japanese Office Action issued on Nov. 18, 2008 in corresponding Japanese Patent Application No. 2006-190580.
Office Action issued Oct. 10, 2008 in corresponding Chinese Patent Application No. 200610101144.1.

* cited by examiner

*Primary Examiner*—Frankie L Stinson
(74) *Attorney, Agent, or Firm*—Staas & Halsey LLP

(57) ABSTRACT

A drum washing machine in which laundry-separated substances, introduced into a gap of a packing member sealing an inlet of the washing machine during a washing process, are easily eliminated. The drum washing machine includes a main body having an entrance hole for placing laundry therein and a door opening and closing the entrance hole, a tub installed in the main body and having an opening corresponding to the entrance hole, a packing member to seal a space between the opening of the tub and the entrance hole. The packing member including a bending portion in which laundry-separate substances accumulate, and a recess adjacent to the bending portion, wherein the recess is formed in a user contactable position on the packing member for assisting in easy elimination of the laundry-separated substances accumulated in the bending portion.

5 Claims, 3 Drawing Sheets

DRUM WASHING MACHINE

CROSS-REFERENCE TO RELATED APPLICATIONS

This application claims the benefit of Korean Patent Application No. 10-2005-0081311, filed Sep. 1, 2005, in the Korean Intellectual Property Office, the disclosure of which is incorporated herein by reference.

BACKGROUND OF THE INVENTION

1. Field of the Invention

The present invention relates to a drum washing machine More particularly, to a structure of a drum washing machine in which laundry-separated substances, introduced into a gap of a packing member sealing an inlet of the washing machine during a washing process, are easily eliminated.

2. Description of the Related Art

Generally, a conventional drum washing machine includes a main body forming the external appearance of the washing machine, an entrance hole formed through the front surface of the main body for placing laundry into the washing machine, a tub fixedly installed in the main body, a drum installed in the tub and rotated in a regular or reverse direction by a step motor for performing a washing operation including washing, rinsing, and dehydrating modes, and a drainage hose and a drainage pump for discharging water through a space between the tub and the drum.

A packing member made of a material having high elasticity is installed between the entrance hole of the main body and an opening of the tub adjacent to the entrance hole of the main body so as to seal the inside of the tub. The packing member includes a bellows shape, thereby absorbing the vibration of the drum generated due to the rotation of the drum. Laundry-separated substances, i.e., items such as coins, papers, and lint, which are separated from laundry during the washing process, together with water may enter into grooves formed in the bellows-shaped packing member.

The above laundry-separated substances together with water enter into the grooves formed in the packing member, and the laundry-separated substances cannot be easily seen, and it is difficult to clear away the packing member. Thus, the laundry-separated substances in the packing member remain. The accumulated laundry-separated substances discolor the packing member, or are introduced into a space between the tub and the drum, thereby clogging the drainage pump, or being discharged to the outside of the washing machine when a door of the washing machine is opened.

SUMMARY OF THE INVENTION

Accordingly, it is an aspect of the present invention to provide a drum washing machine, which easily checks whether or not laundry-separated substances are inserted into grooves formed in a packing member formed in a bellows shape during a washing process, easily clears away the laundry-separated substances, and, when the laundry-separated substances together with water are introduced into a main body, discharges only the water without discharging the laundry-separated substances.

Additional aspects and/or advantages of the invention will be set forth in part in the description which follows and, in part, will be apparent from the description, or may be learned by practice of the invention.

The foregoing and/or other aspects of the present invention are achieved by providing a drum washing machine including a main body having an entrance hole to place laundry therein and a door opening and closing the entrance hole, a tub installed in the main body and having an opening corresponding to the entrance hole, a packing member to seal a space between the opening of the tub and the entrance hole, the packing member including a bending portion in which laundry-separate substances accumulate, and a recess adjacent to the bending portion, wherein the recess is formed in a user contactable position on the packing member for assisting in easy elimination of the laundry-separated substances accumulated in the bending portion.

The packing member further includes a contact portion contacting with the door, and a sealing portion extended from the contact portion towards the opening of the tub.

The bending portion is formed between the contact portion and the sealing portion.

The recess is formed in the contact portion.

The recess is formed in a lower part of a circular contact portion provided along a circumference of the entrance hole.

The packing member further includes at least one drainage hole through the bending portion and the tub so as to discharge the water introduced into the bending portion.

An inner diameter of the contact portion is greater than or equal to an inner diameter of the sealing portion.

It is another aspect of the present invention to provide a packing member of the drum washing machine having a main body including an entrance hole to place laundry therein, a tub installed in the main body and having an opening corresponding to the entrance hole, a drum installed in the tub, and a door opening and closing the entrance hole, the packing member including a contact portion contacting the door, a sealing portion extended from the contact portion towards the opening of the tub, a bending portion in which laundry-separate substances accumulate, and a recess adjacent to the bending portion, wherein the bending portion is formed between the contact portion and the sealing portion so that a vibration of the drum is absorbed by the bending portion, and the recess is formed in a user contactable position on the packing member for assisting in easy elimination of the laundry-separated substances accumulated in the bending portion.

BRIEF DESCRIPTION OF THE DRAWINGS

These and/or other aspects and advantages of the invention will become apparent and more readily appreciated from the following description of the embodiments, taken in conjunction with the accompanying drawings in which.

DETAILED DESCRIPTION OF THE PREFERRED EMBODIMENTS

Figure 1:
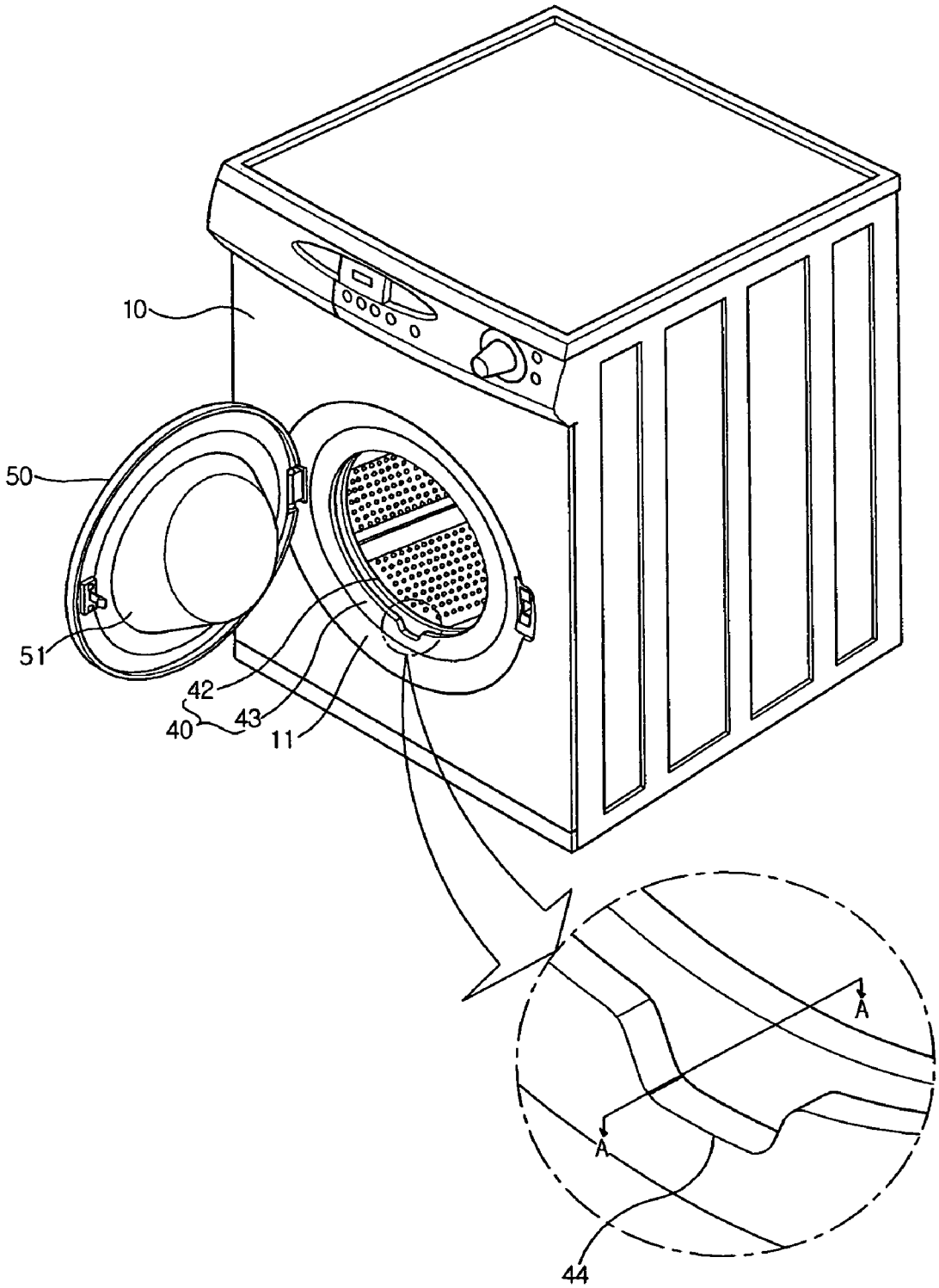
FIG. 1 illustrates a perspective view of a drum washing machine in accordance with an embodiment of the present invention.

Reference will now be made in detail to the embodiment of the present invention, an example of which is illustrated in the accompanying drawings, wherein like reference numerals refer to like elements throughout. The embodiment is described below to explain the present invention by referring to the figures.

Figure 2:
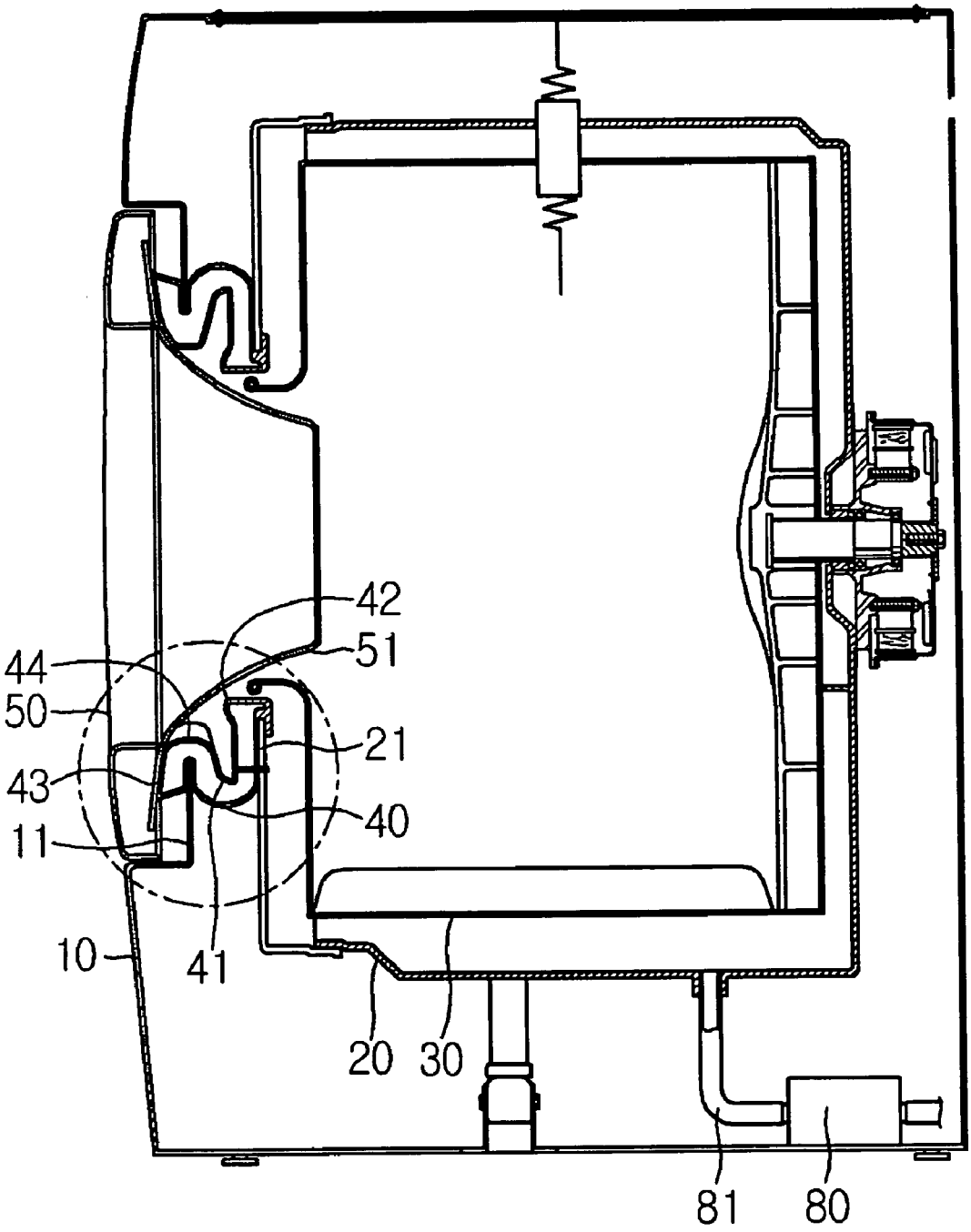
FIG. 2 illustrates a sectional view of the drum washing machine shown in FIG. 1, in a state in which a door is closed.
Figure 3:
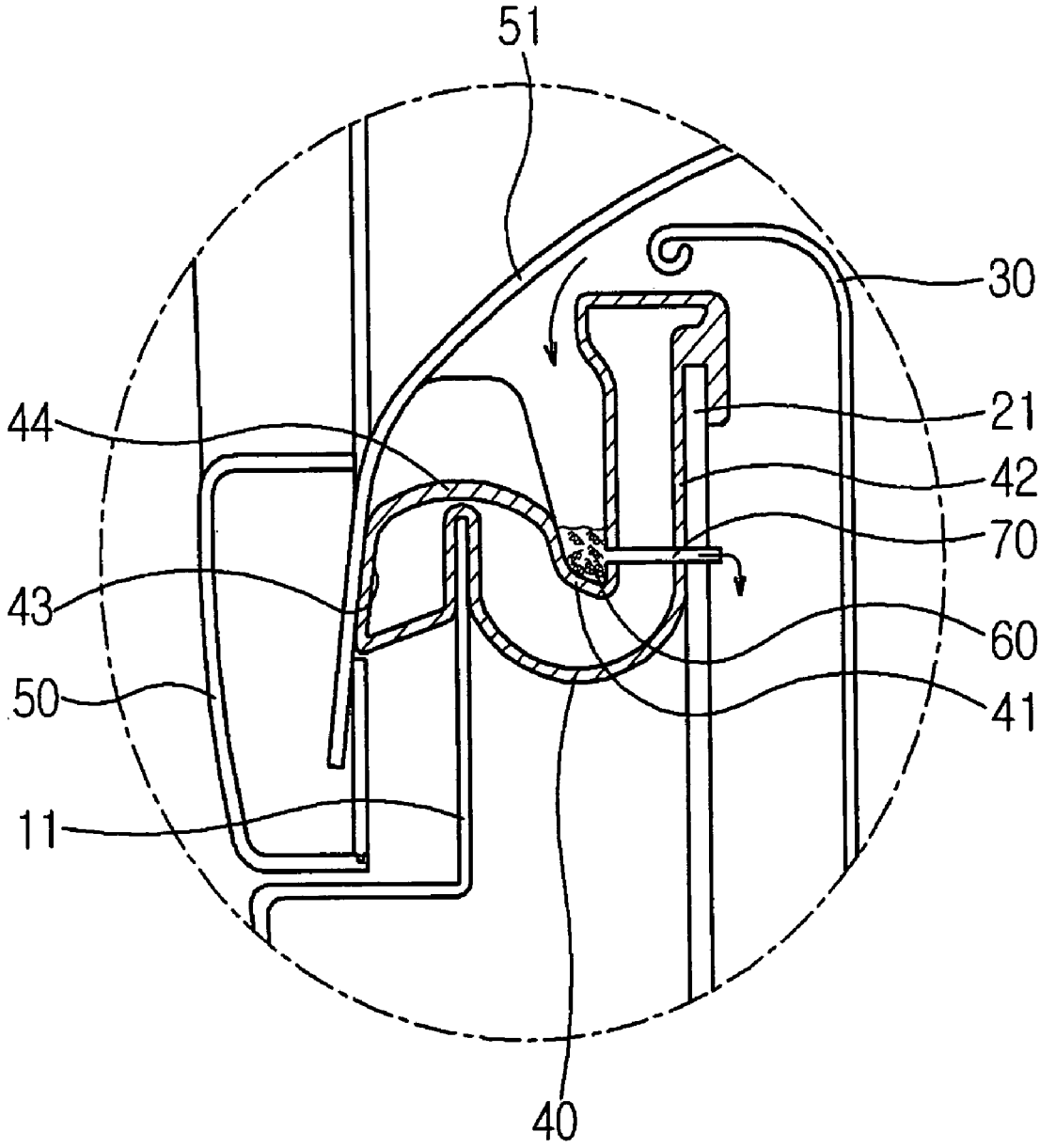
FIG. 3 illustrates a sectional view taken along the line A-A of FIG. 1.

FIG. 1 illustrates a perspective view of a drum washing machine in accordance with an embodiment of the present invention. FIG. 2 illustrates a sectional view of the drum washing machine shown in FIG. 1, in a state in which a door is closed. FIG. 3 illustrates a sectional view taken along the line A-A of FIG. 1.

In FIGS. 1 and 2, the drum washing machine comprises a main body 10, a tub 20 installed in the main body 10, a drum 30 installed in the tub 20, and a packing member 40 interconnecting an opening 21 of the tub 20 and an entrance hole 11 of the main body 10 to maintain a sealing of the inside of the washing machine. A detailed description of some parts of the drum washing machine of the present invention, which are substantially the same as those of the conventional drum washing machine, will be omitted because it is considered to be unnecessary.

In FIG. 2, the packing member 40 interconnects the opening 21 of the tub 20 and the entrance hole 11 of the main body 10 to seal the tub 20. The packing member 40 comprises a material having high elasticity, such as rubber, for example. The packing member 40 installed between the opening 21 of the tub 20 and the main body 10 comprises a bellows shape, and one end of the packing member 40 contacts a transparent member 51 connected with an inner surface of a door 50, sealing the inside of the washing machine from the outside of the washing machine. Here, a portion of the packing member 40 contacting the transparent member 51 of the door 50 is defined as a contact portion 43, and the remaining portion of the packing member 40 is defined as a sealing portion 42.

The packing member 40 in the bellows shape absorbs vibration, generated from the drum 30 when the drum 30 is rotated to wash laundry, so that the vibration is not transmitted to the door 50. Due to the bellows shape of the packing member 40, a bending portion 41 having a groove of relatively large depth so as to prevent water from being collected in the bending portion 41 by splashing during the washing or dehydrating process is formed in the sealing portion 42.

In FIGS. 2 and 3, during the washing process, a large amount of laundry-separated substances 60, i.e., items such as coins, bills, papers, and lint, may be separated from laundry. These laundry-separated substances 60 together with the splashed water are inserted into the bending portion 41. Among the laundry-separated substances and the water inserted into the bending portion 41, the water is discharged to the outside through a drainage hole 70 formed through the bending portion 41 and the front surface of the tub 20. The water discharged through the drainage hole 70 and water discharged during the washing process are discharged to the outside of the washing machine through a drainage hose 81 by a drainage pump 80.

The drainage hole 70 comprises a small diameter sufficient to easily discharge the water and not to easily discharge the laundry-separated substances 60. It is not necessary to form a plurality of the drainage holes 70 throughout the circumference of an inlet of the drum washing machine, i.e., along the circumference of the entrance hole 11. That is, at least one drainage hole 70 may be formed through the lower part of the sealing portion 42 of the packing member 40 formed around the inlet of the drum washing machine.

A user must eliminate the laundry-separated substances 60, which remain after the discharge of the water from the bending portion 41, by cleaning. In order to easily clear away the laundry-separated substances 60, a recess 44 is formed in the contact portion 43 of the packing member 40. The recess 44 formed in the packing member 40, more particularly, the contact portion 43, has a designated distance. Specifically, the recess 44 is formed only in a designated section of the lower end of the contact portion 43 formed around the circumference of the entrance hole 11. In the case that the section of the contact portion 43 in which the recess 44 is formed is excessively long, the contact portion 43 cannot firmly contact the transparent member 51 of the door. Accordingly, the recess 44 is formed in a section range smaller than a circumference of a semicircular lower part of the contact portion 43. That is, when the laundry-separated substances 60 generated during the washing process together with water are inserted into the bending portion 41 of the packing member 40, the laundry-separated substances 60 and the water are lowered by gravity and are collected in the lower part of the bending portion 41. Then, the water is discharged from the bending portion 41 through the drainage hole 70, and the laundry-separated substances 60 are accumulated in the lower part of the bending portion 41. The recess 44 is formed at an angle of approximately 10° to 30° from a center of the inlet of the drum washing machine.

The recess 44 is excessively deeply formed from the upper end of the contact portion 43, the contact portion 43 cannot steadily contact the transparent member 51. Therefore, the recess 44 is formed such that an upper end of the recess 44 is formed at a level half a distance from a lower end of the contact portion 43 to an upper end of the contact portion 43.

Further, an inner diameter of the upper end of the contact portion 43 is equal to or greater than an inner diameter of the upper end of the sealing portion 42, thereby reducing an insertion of the laundry-separated substances 60, generated during the washing process, into the packing member 40. In order to reduce the insertion of the laundry-separated substances 60 into the packing member 40, a protrusion is protruded from the upper end of the sealing portion 42 towards the door 50.

During the washing process, large amounts of laundry-separated substances 60 and water are introduced into the drum washing machine from the outside. When the laundry-separated substances 60 are introduced into a space between the tub 20 and the drum 30, problems, such as clogging of the drainage pump 80, are encountered. The front surface of the tub 20 comprises a length sufficient to cover at least half of an upper end of the sealing portion 42.

As apparent from the above description, the present invention provides a drum washing machine, in which laundry-separated substances generated during a washing process are accumulated in a bending portion formed in a packing member, and a user easily detects the accumulation of the laundry-separated substances and eliminates the laundry-separated substances, thereby preventing the packing member from being contaminated or discolored by the accumulated laundry-separated substances, improving operating conditions, and reducing offensive odors.

Although an embodiment of the invention has been shown and described, it would be appreciated by those skilled in the art that changes may be made in this embodiment without departing from the principles and spirit of the invention, the scope of which is defined in the claims and their equivalents.

What is claimed is:

1. A drum washing machine comprising:

a main body having an entrance hole to place laundry therein and a door opening and closing the entrance hole;

a tub installed in the main body and having an opening corresponding to the entrance hole;

a packing member to seal a space between the opening of the tub and the entrance hole, the packing member comprising a contact portion contacting the door, a sealing portion extended from the contact portion towards the opening of the tub;

a bending portion formed between the contact portion and the sealing portion, in which laundry-separate substances accumulate, and a recess formed in the contact portion to provide manual access to the laundry-separated substances accumulated in the bending portion.

2. The drum washing machine as set forth in claim 1, wherein the recess is formed in a lower part of the contact portion and the contact portion is circular.

3. The drum washing machine as set forth in claim 1, wherein the packing member further comprises:

at least one drainage hole through the bending portion and the tub to discharge the water introduced into the bending portion.

4. The drum washing machine as set forth in claim 1, wherein an inner diameter of the contact portion is greater than or equal to an inner diameter of the sealing portion.

5. A drum washing machine comprising:

a main body having an entrance hole to place laundry therein and a door opening and closing the entrance hole;

a tub installed in the main body and having an opening corresponding to the entrance hole;

a packing member to seal a space between the opening of the tub and the entrance hole, the packing member comprising a bending portion in which laundry-separate substances accumulate, and a recess formed between a front of the packing member and the bending portion to provide manual access to the laundry-separated substances accumulated in the bending portion.

* * * * *